US006843329B2

(12) United States Patent
Mathis

(10) Patent No.: US 6,843,329 B2
(45) Date of Patent: Jan. 18, 2005

(54) ROTARY PERCUSSION DEVICE FOR A DRILL COLUMN

(76) Inventor: Andrea Linard Mathis, Tobelweg 64, CH-8706 Feldmeilen (CH)

( * ) Notice: Subject to any disclaimer, the term of this patent is extended or adjusted under 35 U.S.C. 154(b) by 0 days.

(21) Appl. No.: 10/276,433

(22) PCT Filed: Jun. 5, 2001

(86) PCT No.: PCT/CH01/00344

§ 371 (c)(1),
(2), (4) Date: Dec. 12, 2002

(87) PCT Pub. No.: WO01/94079

PCT Pub. Date: Dec. 13, 2001

(65) Prior Publication Data

US 2004/0099425 A1 May 27, 2004

(30) Foreign Application Priority Data

Jun. 6, 2000 (EP) ..... 00112146

(51) Int. Cl.[7] ..... E21B 6/00

(52) U.S. Cl. ..... 173/105; 173/49; 173/104; 173/111; 173/134

(58) Field of Search ..... 173/49, 104, 105, 173/111, 134, 139

(56) References Cited

U.S. PATENT DOCUMENTS 3,157,237 A * 11/1964 Kurt ..... 173/105
3,166,131 A * 1/1965 Worman ..... 173/105
3,307,638 A * 3/1967 Kurt ..... 173/105
3,368,634 A * 2/1968 Lear ..... 173/105
3,490,549 A * 1/1970 Catterson ..... 173/207
3,844,359 A * 10/1974 Zettergren et al. ..... 173/105
4,068,727 A * 1/1978 Andersson et al. ..... 173/1
4,073,350 A * 2/1978 Eklof et al. ..... 173/212
4,366,868 A * 1/1983 Salmi ..... 173/105
4,842,080 A * 6/1989 Heinonen ..... 173/105
5,415,240 A * 5/1995 Mundjar ..... 173/48

FOREIGN PATENT DOCUMENTS

DE 1 909 931 9/1969
DE 26 10 619 9/1976
DE 37 14 884 A1 11/1987

OTHER PUBLICATIONS

"DEPS: Doppel–Schlagbohrsystem, Die schnellste Bohrmethode in kiüftigen Formationen," Company publication from Atlas Copco No. 6991 0757 04a, Mar. 1998, pp. 1–4.

* cited by examiner

*Primary Examiner*—Scott A. Smith
*Assistant Examiner*—Nathaniel Chukwurah
(74) *Attorney, Agent, or Firm*—Oliff & Berridge, PLC

(57) ABSTRACT

The inventive rotary percussion device (1) used for driving at least one drill column (2) disposes of a percussion device (6) and a rotary device (5) and of an insertion end (3), which is rotatably mounted in a device body (8) and which has an axial boring, in which a percussion piston (4) is displaceably mounted. The insertion end (3), which is connected to the drill column (2) by a connection piece (33), is driven by the rotary device (5), and the percussion piston (4) mounted in the insertion end (3) is driven independently thereof by the percussion device (6). The percussion energy transmitted to the drill column (2) via the percussion piston (4) has, as a result, largely reduced influences upon the insertion end (3) that, according to the invention, is decoupled from the percussion device (5) so that premature material fatigue is prevented. In addition, the noise emissions occurring during the operation of the inventive rotary percussion device (1) are largely reduced.

12 Claims, 2 Drawing Sheets

ROTARY PERCUSSION DEVICE FOR A DRILL COLUMN

Figure 1:
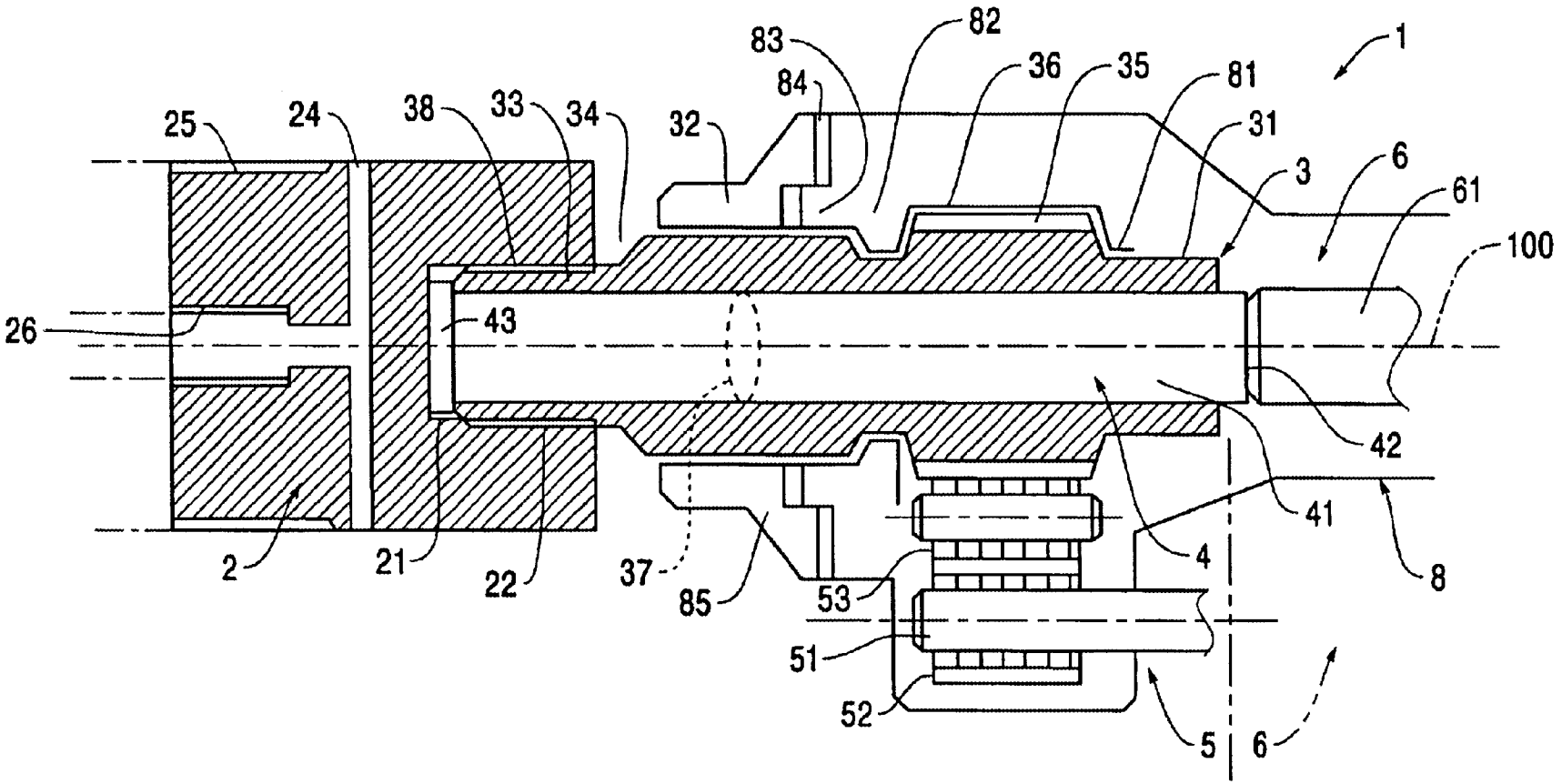

The invention relates to a rotary percussion device for a drill column as claimed in claim 1.

DE-A-19 09 931 discloses devices of the generic type in which a machine is provided which exerts firstly a rotary movement and secondly blows on a drill column provided with a drill bit. These devices often have inner and outer drill columns which if need be can be acted upon independently of one another in a rotary-percussive manner. To carry away drillings which are released during the operation of the device in a drill hole, a passage through which a transport medium is additionally directed is preferably provided inside the outer drill column. To fasten the drill column, the rotary percussion device has a drill holder or an "insertion end" with a connecting piece, by means of which the rotary and percussion energy produced by the rotary percussion device is transmitted to the drill column.

Devices of this type, as shown, for example, in the company publication from Atlas Copco No. 6991 0757 04a dated March 1998, permit the transmission of high outputs and accordingly produce high drilling capacities, such as high drilling advance and low costs per meter of hole.

In these known devices, however, the application of high rotary and percussion energy leads to high mechanical stressing of the insertion end, in particular of the connecting piece and of the rotary tooth system, so that these parts have to be replaced in each case after a relatively short period of use, which results in a considerable maintenance cost and limited availability of the device.

The possible period of use of the insertion end serving as rotary percussion receiver can be increased by the percussion energy being reduced. To increase the drilling capacities, however, increasingly higher percussion energy is aimed at.

The object of the present invention is therefore to provide a rotary percussion device for a drill column, which rotary percussion device has a higher loading capacity, so that, with increased availability of the device, higher percussion energy can be applied.

This object is achieved with a device which has the features specified in claim 1. Preferred configurations of the invention are specified in the further claims.

The rotary percussion device according to the invention serving to drive at least one drill column has a percussion device and a rotary device and also an insertion end which is mounted in a rotatable manner in a device body and has an axially running bore, in which a percussion piston is mounted in an axially displaceable manner. The insertion end, connected to the drill column by means of a connecting piece and preferably a rotary percussion receiver, is driven by the rotary device, and the percussion piston mounted in the insertion end is driven independently thereof by the percussion device. The percussion energy transmitted via the percussion piston to the rotary percussion receiver acted upon with high torque therefore has greatly reduced effects on the insertion end, which according to the invention is isolated from the percussion device and, on account of the reduced loading, can be operated for a relatively long time without material fatigue occurring, this material fatigue necessitating repair of the rotary percussion device. The rotary percussion device according to the invention is therefore not costly to maintain and repair. Furthermore, on account of the extension of the maintenance intervals, the availability of the device increases, which results in a marked reduction in the operating costs.

In addition, a marked reduction in the noise which occurs during the operation of such devices is achieved with the rotary percussion device according to the invention. The insertion end, isolated according to the invention from the percussion device, no longer acts as a resonance body and at the same time insulates vibrations of the percussion piston. The reduction in noise relieves the burden on the personnel and other persons who are possibly in the vicinity of the device put into operation.

The device body is preferably configured in such a way that at least two spaced-apart regions are provided therein, in which regions the insertion end, driven, for example, via gearing by means of a preferably hydraulically or pneumatically working rotary drive, can be mounted.

In a further preferred configuration, the insertion end, between the regions in which it is mounted in the device body, has a stop surface which corresponds to a retaining element which is connected to the device body and by means of which the insertion end is held in the axial direction and damped if need be. The insertion end preferably has an external tooth system, in which a gear engages or which is enclosed by a ring which is provided with an internal tooth system and on the periphery of which coupling elements for the engagement of the rotary device are provided.

If need be, the insertion end has a flange following the connecting piece to be connected to the rotary percussion receiver, this flange being supported on a part of the device body which encloses the insertion end on the output side. This part enclosing the insertion end on the output side can be connected to the device body via a preferably hydraulic damping element, so that the insertion end, during vibrations and blows of the percussion mechanism, can oscillate at the same time. Percussion energy transmitted indirectly to the insertion end therefore causes no material deformations, for example on the connecting piece, but rather is absorbed in the damping element. As mentioned above, the retaining element, e.g. a retaining ring, may instead be connected to a damping element. The insertion end and in particular the connecting piece connected to the rotary percussion receiver are therefore not only isolated from the percussion energy which is delivered directly from the percussion device and is fed to the rotary percussion receiver via the percussion piston but are also isolated from the percussion energy transmitted indirectly via the rotary percussion receiver, so that premature material fatigue at the connecting point between insertion end and rotary percussion receiver is avoided. The solution according to the invention means that damage to the insertion end and to the rotary percussion receiver is avoided.

The percussion piston provided in the insertion end preferably consists of a cylindrical part and of a flange which partly projects beyond the connecting piece or a shoulder provided therein and prevents the percussion piston from running back axially due to the reactions of the drill column.

The invention can also be advantageously used in "double percussion mechanisms". To this end, the percussion piston and a percussion hammer, interacting with the percussion piston, of the percussion device have axially running bores, in which drive means driven by a further rotary device and/or a further percussion device are provided for a second drill column preferably arranged inside the first drill column.

An inner insertion end, preferably a rotary percussion shaft, which can be connected directly or indirectly to the second drill column is preferably provided in said bores of the percussion piston and of the percussion hammer, this insertion end being acted upon in a rotary and/or percussive manner or being acted upon in a rotary manner and being provided with an axially running bore, inside which an inner percussion piston acted upon in a percussive manner is arranged. This preferably mutual isolation of the inner insertion end and of the inner percussion piston results in turn in reduced loading of these device parts with if need be simultaneously increased drilling capacity.

Figure 2:
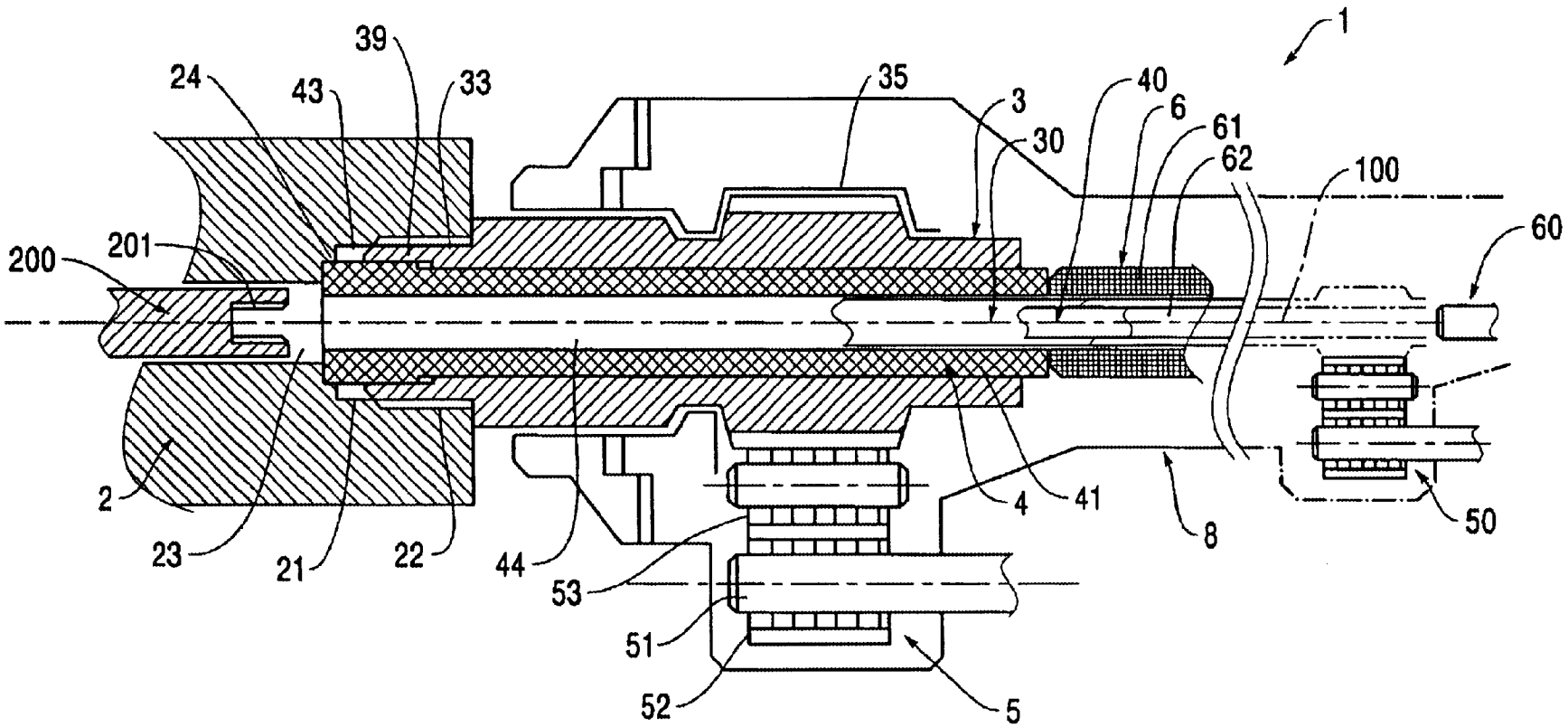

The rotary percussion device according to the invention is explained below in more detail with reference to exemplary embodiments shown in drawings, in which:

FIG. 1 shows a rotary percussion device according to the invention in section, this rotary percussion device serving to drive a drill column, and FIG. 2 shows a rotary percussion device according to the invention in section, this rotary percussion device serving to drive an inner and an outer drill column.

FIG. 1 shows a rotary percussion device 1 according to the invention which serves to drive a drill column and has a cylinder housing or a device body 8 in which a rotary device 5 coupled to an insertion end 3 and a percussion mechanism or a percussion device 6 are provided, the rotary percussion device 1 interacting with a percussion piston 4 mounted in a displaceable manner in an axially running bore 37 of the insertion end 3.

The insertion end 3, which serves to transmit a torque produced by the rotary device 5 to a rotary percussion receiver 2 which can be connected to the drill column, has two spaced-apart cylindrical sections 31, 32 which are mounted in the device body 8 in corresponding regions 81, 83 or are enclosed by bearing shells.

Between said cylindrical sections 31, 32, the insertion end 3 has a tooth system 35 which is coupled via gearing 52, 53 to a drive shaft 51 of the rotary device 5, the drive shaft preferably being driven by a hydraulic or pneumatic rotary drive.

Between the second cylindrical section 32 mounted in the device body 8 and the tooth system 35, the insertion end 3 has an annular groove 36, into which a retaining ring 82 connected to the device body 8 projects, and this retaining ring 82 strictly limits displacements of the insertion end 3 along its axis 100 and is preferably connected to a damping element 84 which dampens vibrations and blows.

That end of the insertion end 3 which faces the rotary percussion receiver 2 and leads out of the device body 8 has a connecting piece 33 with an external thread 38, which is screwed into a tapped hole 21, provided with an internal thread 22, in the rotary percussion receiver 2.

The percussion piston 4 has a first end piece 42, which faces the percussion device 6 and is acted upon by a likewise piston-shaped percussion hammer 61, a cylindrical body 41 mounted in the bore 37 of the insertion end 3, and a second end piece 43 which, in the form of a flange, overlaps the connecting piece 33 at the front inside the tapped hole 21 provided in the rotary percussion receiver 2 and is preferably held in place between connecting piece 33 and rotary percussion receiver 2. Blows delivered by the percussion device 6 or the percussion hammer 61 are therefore transmitted by means of the percussion piston 4 directly to the rotary percussion receiver 2.

Following the connecting piece 33 connected to the rotary percussion receiver 2, the insertion end 3 has a conically running flange 34 which, in a further configuration of the invention, may serve as a stop for the rotary percussion receiver 2.

In a preferred configuration, the flange 34 is of annular design and is arranged on one side to follow a part 85 of the device body 8 which encloses the insertion end 3 on the output side, so that reactions from the drill column are transmitted to the part 85. In this case, the part 85 is connected to the device body 8 via a preferably hydraulic damping element, so that the insertion end 3, during vibrations and recoils of the drill column, can oscillate at the same time in a damped manner. Alternatively, the insertion end 3, as shown in FIG. 1, can also be damped by means of a retaining element or a retaining ring 82 which is connected to the device body 8 and to a damping element 84 which dampens vibrations and blows.

Percussion energy transmitted indirectly to the insertion end 3 therefore causes no material deformations, for example on the connecting piece 33 or on the external thread 38 provided thereon, but rather is absorbed in the damping element 84. The insertion end 3 and in particular the connecting piece 33 connected to the rotary percussion receiver 2 are therefore not only isolated from the percussion energy which is delivered directly percussion device 6 and is fed to the rotary percussion receiver 2 via the percussion piston 4 but are also isolated from the percussion energy transmitted indirectly to the insertion end 3 via the drill column and the rotary percussion receiver 2, so that premature material fatigue at the connecting point between insertion end 3 and rotary percussion receiver 2 is avoided.

The rotary percussion receiver 2 shown by way of example in FIG. 1 can be connected to an outer drill column by means of an external thread 25 and to an inner drill column by means of an axial tapped hole 26. Furthermore, a flushing medium can be directed through the tapped hole 26 and an adjoining, outwardly directed passage 24. Of course, the direct connection of the insertion end 3 to the drill column without the rotary percussion receiver 2, serving as adapter, in between is also possible.

FIG. 2 shows a preferred configuration of the rotary percussion device 1 which is provided for the separate drive of an inner and an outer drill column and to this end has a hollow-cylindrical percussion piston 4 and a hollow-cylindrical percussion hammer 61 interacting with the percussion piston 4, the percussion hammer 61 and the percussion piston 4 being provided with axially running bores 44; 62. Drive means 30, 40 for the second drill column are provided in these bores 44; 62 of the percussion piston 4 and of the percussion hammer 61, these drive means 30, 40 being driven by a second rotary device 50 and a second percussion device 60 and being connected an inner rotary percussion receiver 200 provided with a thread 201 for this purpose. The inner drill column may also be connected directly to the drive means 30, 40. Preferably provided in the inner and outer drill columns, if need be also in the rotary percussion receivers 2, 200 serving as adapters, are passages which serve to feed and discharge a flushing medium or to pass through electric lines.

In the configuration shown in FIG. 2, the rotary percussion device 1, in the bores 44; 62 of the percussion piston 4 and of the percussion hammer 61, has an inner insertion end 30 which is connected to the inner drill column or an inner rotary percussion receiver 200 and is provided with an axially running bore, inside which an inner percussion piston 40 is arranged.

The inner insertion end 30 is driven by the second rotary device 50, whereas the inner percussion piston 40, independently thereof, is acted upon by the second percussion device 60. The functioning of the inner insertion end 30 and of the inner percussion piston 40 and also of the associated drive devices 50, 60 therefore corresponds to the functioning of the corresponding outer device parts 3, 4, 5 and 6. The inner insertion end 30 is therefore likewise largely isolated from the percussion energy which is transmitted by the second percussion device 60 via the inner percussion piston 40 to the inner drill column. Premature material fatigue at critical points is therefore also avoided in these inner device parts 30 and 40 and in the inner rotary percussion receiver 200 or the drill column.

The drive means 30, 40 provided in the bores 44; 62 of the percussion piston 4 and of the percussion hammer 61 may of course also be designed and operated differently. The use of only one inner shaft which is acted upon in a rotary, percussive or rotary-percussive manner is possible.

Furthermore, a further preferred configuration of the second end piece 43, facing the rotary percussion receiver 2, of the percussion piston 4 can be seen from FIG. 2.

The end piece 43 has the form of a flange which is partly sunk in the insertion end 3 and can bear on one side against a shoulder 39 which is provided in the axially running bore 37 and prevents the percussion piston 4 from running back. On the other side, the end piece 43 is sunk in a recess 24 provided in the rotary percussion receiver 2 and adapted to the end piece 43. As a result, other zones of the rotary percussion receiver 2 can be relieved, so that material damage there is avoided.

In particular in the case of relatively small drill columns, there may be clearance between the end piece 43 and the shoulder 39, as shown in FIG. 2.

The rotary percussion device according to the invention and in particular drill columns which can be connected thereto have been described above only in details which are useful for the understanding of the invention. Features of preferable configurations of generic rotary percussion devices and drill columns are of course familiar to the person skilled in the art, which configurations can be used in connection with the present subject matter of the invention without any problems. Adaptations and modifications in particular of the drive devices are easily possible.

What is claimed is:

1. A rotary percussion device for a drill column, having a percussion device and an insertion end which is rotatably mounted in a device body, is coupled to a rotary device and connectable to the drill column via a rotary percussion receiver by means of a connecting portion of said insertion end emerging from the device body, wherein the insertion end has an axially running bore, in which a percussion piston is mounted in a displaceable manner, a first end portion of said percussion piston facing the percussion device and a second end portion of said percussion piston facing the rotary percussion receiver, so that blows delivered by the percussion device are transmitted by means of the percussion piston directly to the rotary percussion receiver.

2. The rotary percussion device as claimed in claim 1, wherein the insertion end has elements which are coupled to the rotary device in a positive-locking manner.

3. The rotary percussion device as claimed in claim 2, wherein the rotary device has at least one of a pneumatically working rotary drive and a hydraulically working rotary drive.

4. The rotary percussion device as claimed in claim 1, wherein the device body has at least two spaced-apart regions, in which the insertion end is mounted.

5. The rotary percussion device as claimed in claim 4, wherein the insertion end has a retaining surface between the spaced-apart regions, said retaining surface corresponding to a retaining element connected to the device body.

6. The rotary percussion device as claimed in claim 5, wherein the retaining element is connected to a hydraulic damping element which is arranged in the device body and by means of which vibrations of the insertion end are damped.

7. The rotary percussion device as claimed in claim 1, wherein the percussion piston includes at the second end portion a cylindrical part comprising a flange which bears on one side against at least one of the connecting portion and a shoulder provided therein.

8. The rotary percussion device as claimed in claim 7, wherein the flange is sunk in a recess provided in the rotary percussion receiver and wherein said recess is adapted to the flange.

9. The rotary percussion device as claimed in claim 1, wherein the percussion piston and a percussion hammer, interacting with the percussion piston, of the percussion device have axially running bores.

10. The rotary percussion device as claimed in claim 9, wherein drive means for a second drill column arranged inside the first drill column are provided in the bores of the percussion piston and of the percussion hammer, the drive means being driven by at least one of a second rotary device and a second percussion device.

11. The rotary percussion device as claimed in claim 10, wherein an inner insertion end which is connectable to the second drill column is provided in the bores of the percussion piston and of the percussion hammer, the inner insertion end being acted upon in at least one of a rotary maimer and/a percussive manner.

12. The rotary percussion device as claimed in claim 10, wherein an inner insertion end which is connectable to the second drill column is provided in the bores of the percussion piston and of the percussion hammer, the inner insertion end being acted upon in a rotary manner, the inner insertion end being provided with an axially running bore, and wherein inside the axially running bore is arranged an inner percussion piston that is acted upon in a percussive manner.

* * * * *